US006006822A

United States Patent [19]

Frank et al.

[11] Patent Number: 6,006,822

[45] Date of Patent: Dec. 28, 1999

[54] CONTROLLABLE VARIABLE MAGNETIC FIELD APPARATUS FOR FLOW CONTROL OF MOLTEN STEEL IN A CASTING MOLD

[75] Inventors: William R. Frank, Bettendorf; Jonathan Dorricott, Davenport, both of Iowa

[73] Assignee: IPSCO Enterprises Inc., Wilmington, Del.

[21] Appl. No.: 09/108,466

[22] Filed: Jul. 1, 1998

Related U.S. Application Data

[60] Provisional application No. 60/051,422, Jul. 1, 1997.

[51] Int. Cl.[6] ..... B22D 27/02

[52] U.S. Cl. ..... 164/502; 164/466

[58] Field of Search ..... 164/466, 502, 164/467, 468, 503, 504, 147.1

[56] References Cited

U.S. PATENT DOCUMENTS

| | | |
|---|---|---|
| 4,244,419 | 1/1981 | Von Starck et al. . |
| 4,601,327 | 7/1986 | Kaneko et al. . |
| 4,848,441 | 7/1989 | Meyer . |
| 5,381,857 | 1/1995 | Tozawa et al. . |
| 5,404,933 | 4/1995 | Andersson et al. . |
| 5,613,548 | 3/1997 | Streubel et al. . |

FOREIGN PATENT DOCUMENTS

| | | | |
|---|---|---|---|
| 2853049 | 6/1979 | Germany | 164/504 |
| 4-71759 | 3/1992 | Japan . | |

*Primary Examiner*—Kuang Y. Lin

*Attorney, Agent, or Firm*—Robert H. Barrigar; Barrigar & Moss

[57] ABSTRACT

An apparatus for providing a magnetic field in a casting mold to slow and redirect in a controllable fashion the flow of liquid steel exiting a submerged entry nozzle in the casting mold using removable laminar elements arrangeable in a horizontal series of vertical stacked arrays in association with corresponding side-by-side laminar constituents of the magnetic field core, or independent field coils for energizing each laminar portion of the magnetic field core, or both. The removable elements are preferably stackable rectangular parallelepiped plates together forming selectably a portion or all of the poles of the core as they extend into proximity with the transverse mold sides at selected locations.

7 Claims, 4 Drawing Sheets

CONTROLLABLE VARIABLE MAGNETIC FIELD APPARATUS FOR FLOW CONTROL OF MOLTEN STEEL IN A CASTING MOLD

Applicants claim the benefit of their prior provisional application, Ser. No. 60/051,422, filed Jul. 1, 1997.

FIELD OF THE INVENTION

The present invention relates to a magnetic field apparatus for controlling the flow of molten steel in a casting mold, and more particularly to an apparatus for providing an adjustable magnetic field in a casting mold to slow and redirect in a controllable fashion the flow of liquid steel exiting a submerged entry nozzle in the casting mold.

BACKGROUND OF THE INVENTION

It is known in the art of steel making to continuously cast molten steel using an oscillating mold, typically a water cooled copper-faced mold, having a straight or curved channel. The mold typically has a rectangular horizontal cross-section as wide as the slab to be cast and with relatively narrow ends that are the thickness of the slab to be cast. Liquid steel in the upper portion of the mold is cooled as it moves downward through the water cooled mold, generating a steel shell as it passes through the mold before exiting the mold at the bottom. The molten steel enters the mold from a tundish through an entry nozzle submerged in the liquid steel in the mold. The submerged entry nozzle is normally located generally centrally of the mold cross-section, and is provided with opposed exit ports that direct liquid steel outwardly toward the narrow sides of the mold, upwardly, downwardly or vertically at 90 degrees to the submerged entry nozzle.

Without a magnetic brake, the flow of liquid steel out of the submerged entry nozzle varies in direction and velocity due to various external conditions. This can create disturbances in the steel flow that affect the slab surface quality and slab internal quality. These disturbances tend to generate undesired temperature imbalances that interfere with uniform solidification of the steel as it passes through the mold and downstream thereof, and also increase the tendency of the steel to incorporate unwanted inclusions from the mold powder/slag/impurities mixture at the meniscus of the liquid steel at the top of the mold. A conventional magnetic brake inhibits these disturbances by reducing the velocity of liquid steel emanating from the submerged entry nozzle, thereby tending to constrict the eddies and prevent them from reaching the end edges of the mold and the upper surface of the pool of liquid steel at the top of the mold.

A conventional magnetic brake is typically comprised of a magnetic circuit energized by direct or slowly varying electric current passing through windings around an iron core. The magnetic circuit passes through the wide faces of the mold so as to provide a magnetic field through the interior of the mold. Normally, in a conventional magnetic brake the magnetic circuit passes through the mold about mid-way along the longitudinal length of the mold and extends so as to overlap the point of entry of liquid steel into the mold from the submerged entry nozzle, but does not extend up to the top of the liquid steel pool nor down to the bottom of the mold.

Although the magnetic field in a conventional magnetic brake can be varied (by varying the amount of current flowing through the windings around the iron core of the magnetic circuit) there is, nevertheless, typically no fine control over the manner in which the magnetic field is applied. Such fine control would improve the ability to control the flow characteristics of the steel as it exits from the submerged entry nozzle in the interest of generating uniform solidification of the shell of cast steel emerging from the mold and in the interest of reducing unwanted inclusion and non-uniform surface effects.

Attempts have been made by various prior workers in the field to provide some variation in the magnetic field applied through the mold. Representative such attempts are disclosed, for example, in U.S. Pat. Nos. 5,404,933 and 5,613,548.

SUMMARY OF THE INVENTION

The present invention is directed generally to apparatus for providing a magnetic field in molten steel inside a mold for casting molten steel, which magnetic field can be reconfigured so as to modify the flow characteristics of molten steel exiting a submerged entry nozzle in the mold both (1) when the mold is not in use, to accommodate changes in the characteristics and dimensions of the steel to be cast in the mold, and (2) during the casting of molten steel in response to changing conditions in the molten steel.

In the aspect of the present invention directed to providing a magnetic field that may be reconfigured between casting runs there is provided a pair of magnetic poles comprising a pair of magnetic field cores, each core surrounded by a discrete coil and located in the vicinity of a discrete opposed wide face of the mold. The cores are connected by a yoke so that the cores and the yoke together with the mold containing molten steel form a complete magnetic circuit so that when the coils are energized magnetic field lines extend from one wide face of the mold to the other. Each magnetic field core has at least one finger in proximity to the proximate wide face of the casting mold. If the core has more than one finger, then the fingers are horizontally spaced and may abut each other or may be spaced apart so as to avoid obstructions. Each finger has removable laminar elements arrangeable in a vertically stacked array extending into proximity with the proximate wide mold face at a selected location. The local magnetic field in the molten steel in the casting mold near each selected location may be varied independently of the local magnetic field in the molten steel in the casting mold near the other selected locations by the removal or addition between casting runs of laminar elements from the proximate array so as to modify flow characteristics of molten steel exiting the submerged entry nozzle into the casting mold during casting runs.

In the aspect of the present invention directed to providing a magnetic field that may be reconfigured during casting, there is provided a set of pairs of magnetic poles comprising a set of pairs of magnetic field cores, each core surrounded by a discrete energizing coil, each pair of cores located adjacent a discrete selected portion of the mold, and each core of any one pair of cores located adjacent a discrete opposed wide face of the mold. All cores adjacent one opposed wide face of the mold are connected to all cores adjacent the other opposed wide face of the mold by a yoke made of magnetic material. A discrete electrical current may be passed through each coil. When the mold contains molten steel, a set of magnetic circuits is formed, each one of which passes through one core of one discrete pair of cores, the yoke, the other core of that pair of cores, and the adjacent selected portion of the mold and the molten steel contained therein so that when the coils are energized magnetic field lines extend from one wide face of the mold to the other. The local magnetic field in any one of the selected portions of the mold may be varied by varying the electrical currents passing through the pairs of coils associated with the pairs of magnetic field cores near that selected portion of the mold so as to modify flow characteristics of molten steel exiting the submerged entry nozzle into the casting mold. As each pole is provided with a discrete energizing coil, each pole may be energized independently, thereby providing control of the local magnetic field in the molten steel in the casting mold during casting.

In a further aspect, the two aspects of the invention discussed in the preceding two paragraphs may be combined to provide modification and control over the flow characteristics of the molten steel exiting the submerged entry nozzle into the casting mold both between casting runs and during casting. In this further aspect of the invention each core has at least one discrete finger having removable laminar elements. If a core has more than one finger, then the fingers are horizontally spaced and may abut each other or may be spaced apart so as to avoid obstructions.

Further, the cores, including at least some of the removable laminar elements, and the yoke may be made of iron or an alloy chiefly composed of iron and the removable laminar elements may be stackable rectangular parallelepiped plates.

BRIEF DESCRIPTION OF THE DRAWINGS

In the drawings, which illustrate embodiments of the invention.

DETAILED DESCRIPTION OF THE INVENTION

Figure 1:
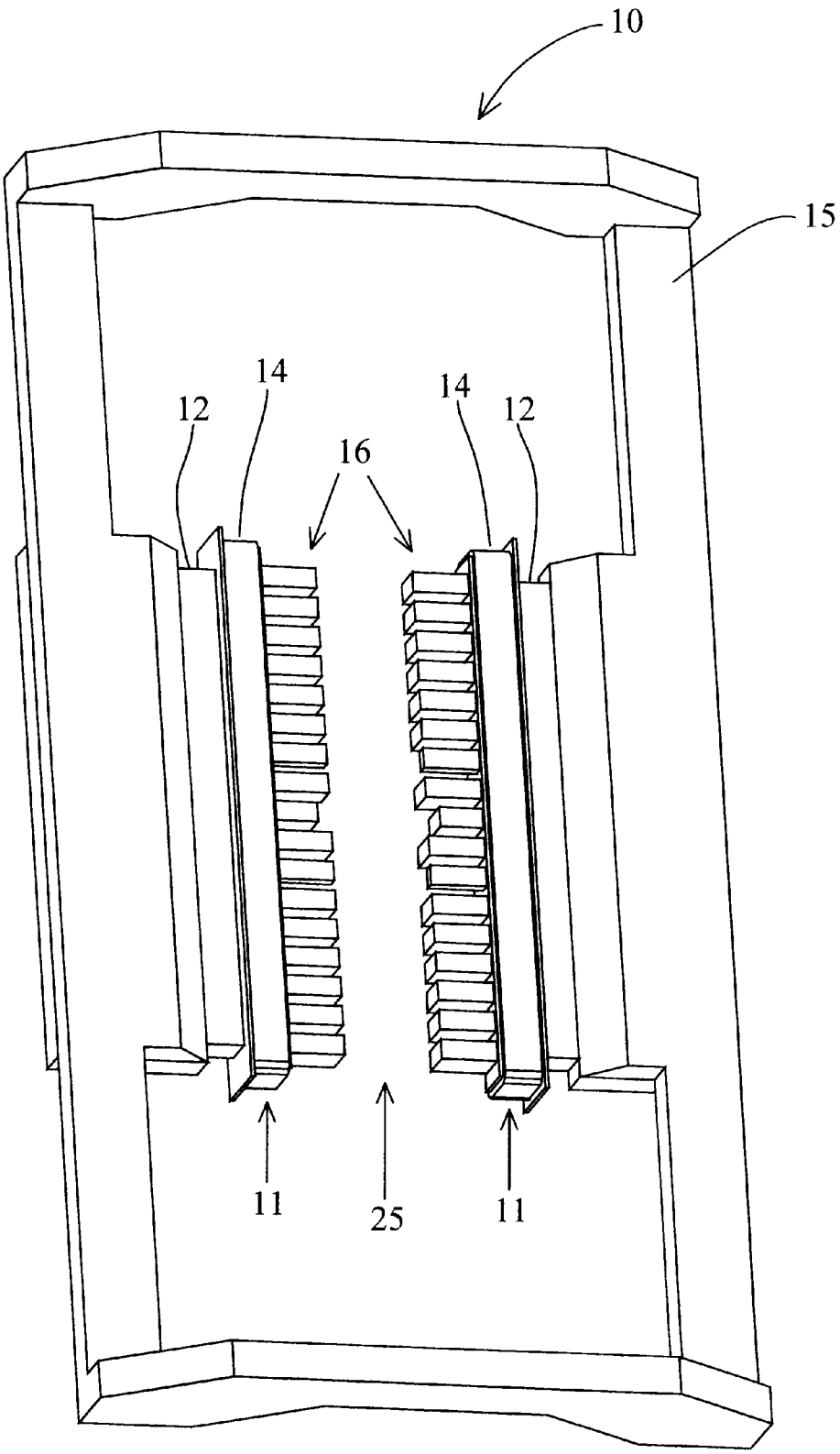
FIG. 1 is a schematic bottom isometric view of an apparatus suitable for embodying magnetic brake structure in conformity with the present invention.

A magnetic field apparatus that is an embodiment of the present invention is generally indicated by numeral 10 in FIG. 1. Apparatus 10 is comprised of two magnetic cores 12, each surrounded by a discrete coil 14. The cores 12 are connected together by a yoke 15 leaving a gap 25 for a casting mold (not shown in FIG. 1, but discussed below). In use, the casting mold and liquid steel in it complete a magnetic circuit including the yoke 15 and the cores 12.

On either side of the gap 25, the cores 12 are split into separate fingers, which are indicated generally by reference numeral 16. Ideally there would be no space between the fingers 16, and the fingers 16 would come into close proximity with the casting mold, so that with the mold in place receiving liquid steel, there would be two minimal gaps in the magnetic circuit.

Figure 2:
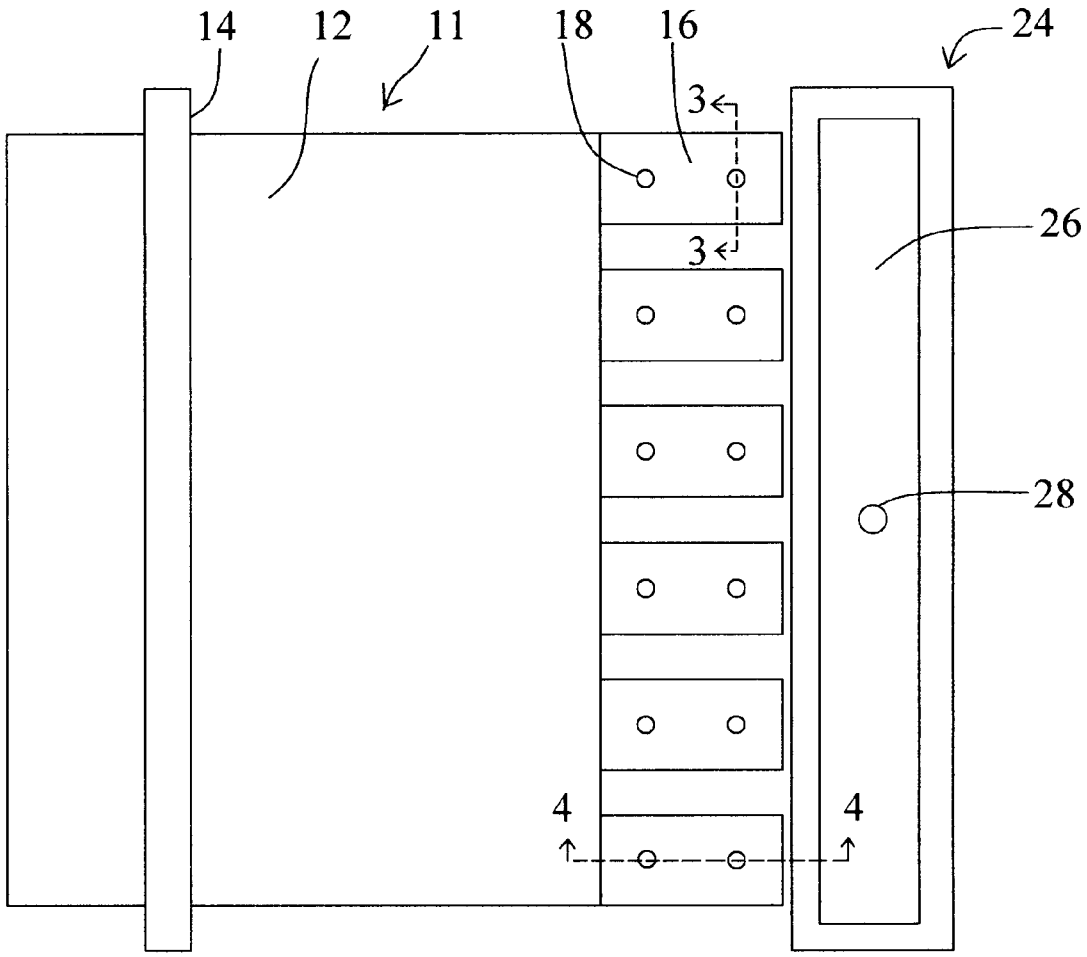
FIG. 2 is a schematic plan view of one magnetic pole of the apparatus of FIG. 1 and an associated casting mold.

FIG. 1 illustrates a pair of discrete magnetic poles 11 each comprised of one core 12 surrounded by an associated coil 14 and ending in fingers 16. In FIG. 2, one of the magnetic poles 11 of the apparatus 10 is shown close to one wide face of a casting mold 24 having a mold cavity 26 and a submerged entry nozzle 28. The end of the magnetic core 12 close to the casting mold 24 is split into several protruding fingers 16 which are shown in further detail in FIGS. 3 and 4. As discussed above, the empty horizontal spacing between the fingers 16 could be eliminated where possible. The spacing is needed only when there are obstructions associated with the external water jacket and any other structural features (not shown) of the mold itself which must pass between the magnetic core 12 and the casting mold 24. In FIG. 2, the schematically uniform spacing between the fingers 16 is shown for ease of illustration only.

Figure 3:
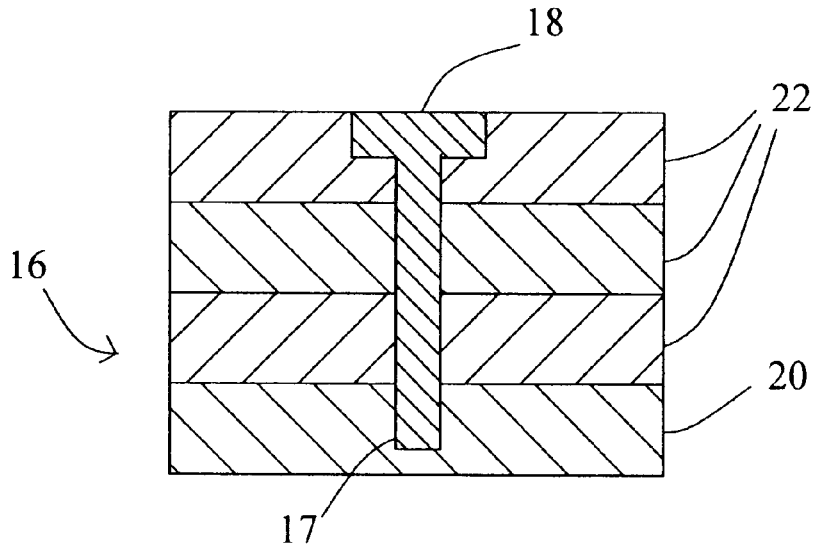
FIG. 3 is schematic end elevation section view of a finger of the magnetic pole of FIG. 2 taken along the line 3—3 of FIG. 2, illustrating a vertically stackable series of removable plates in conformity with one aspect of the invention.
Figure 4:
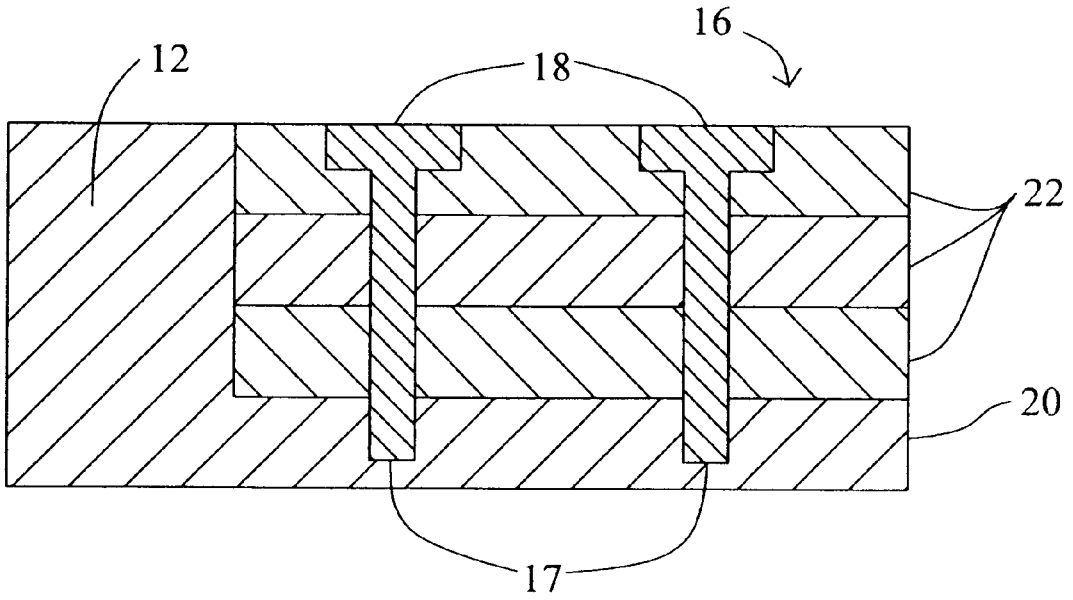
FIG. 4 is schematic side elevation section view of a finger of the magnetic pole of FIG. 2 taken along the line 4—4 of FIG. 2, and illustrating the vertically stackable series of removable plates seen also in FIG. 3, in conformity with one aspect of the invention.

As illustrated in FIGS. 3 and 4, each finger 16 has a fixed end piece 20 which is an extension of the magnetic core 12. Each fixed end piece 20 is provided with bores 17 threaded for receiving bolts 18. Removable end pieces 22 in the form of relatively small rectangular parallelepiped plates, four of which are illustrated by way of example but not by way of limitation, are secured to the fixed end piece 20 using bolts 18 to build up a laminated structure having a selectable amount of magnetic material. The amount of magnetic material in a particular finger 16 directly affects the structure and strength of the magnetic field in the casting mold 24 in the vicinity of that finger 16; increasing the amount of magnetic material increases the magnetic field locally. Note that the magnetic field in the casting mold 24 may be quickly and easily varied by selecting the number of removable end pieces 22 for each finger 16 (as well as the current flow through the associated coil 14; see the discussion of FIG. 5 below) to produce the desired patterns of flow in the molten steel.

Figure 5:
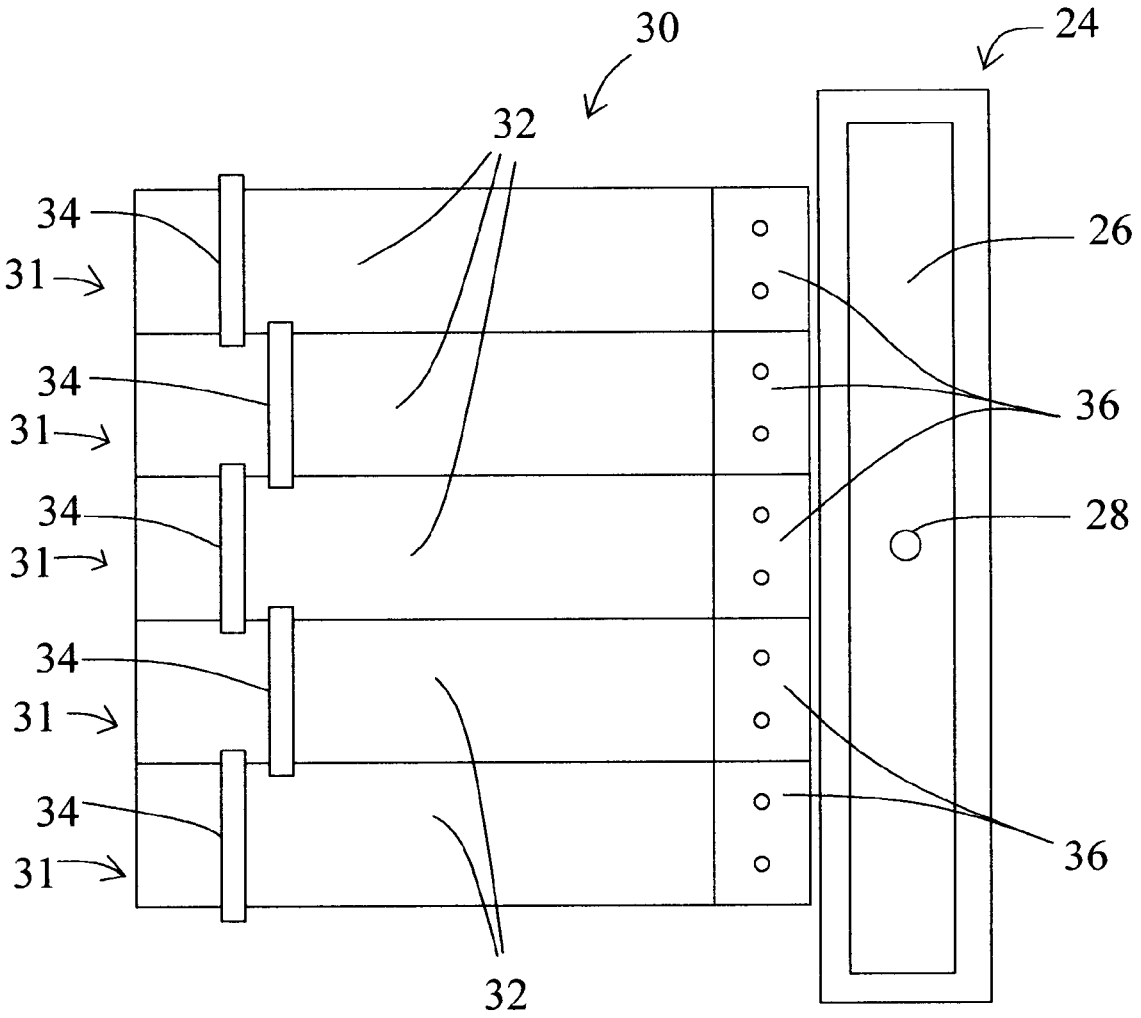
FIG. 5 is a schematic plan view of a multipole variant of an apparatus embodying the present invention, illustrating the multiple energizing coil feature of one aspect of the invention.

Additional control over the magnetic field in a casting mold 24 may be achieved by use of more than one magnetic pole as illustrated in FIG. 5. Reference numeral 30 in FIG. 5 generally indicates a five-pole system with each pole 31 comprised of a core 32, an associated coil 34, and, in this illustration, one finger 36. More than one finger 36 per pole 31 may be used if necessary. FIG. 5 illustrates an idealized case in which there are no obstructions. However, for even better control it may be advantageous to use more than one finger per pole (with no spacing between fingers) even in the absence of obstructions. Each finger 36 has the structure illustrated in FIGS. 3 and 4 and described above for the single pole case, namely, a fixed end piece 20 to which replaceable end pieces 22 may be bolted to build up a laminated structure having a selectable amount of magnetic material.

By independently controlling electrical current passing through the coils 34, the configuration of the magnetic field in the casting mold 24 may be controlled during the casting process. For example, a selected replaceable end pieces 22 may have been removed to produce a uniform magnetic field when the current passing through the coils 34 is set at a selected set of values, but during casting a non-uniform magnetic field may become advantageous. A non-uniform magnetic field may then be obtained without stopping the casting process by increasing the current to some of the coils 34, while reducing or maintaining the current passing through others of the coils 34. The particular changes to be made may be determined empirically and depend upon such factors as the type of steel being cast, the dimensions of the mold 24, the temperature distribution of the molten steel in the mold 24, the rate at which molten steel is flowing into the mold 24 through the submerged entry nozzle 28, and the temperature of the molten steel flowing into the mold 24 through the submerged entry nozzle 28.

While particular elements, embodiments and applications of the present invention have been shown and described, it will be understood, of course, that the invention is not limited thereto, since modifications may be made by those skilled in the applicable technologies, particularly in light of the foregoing description. The appended claims include within their ambit such modifications and variants of the exemplary embodiments of the invention described herein as would be apparent to those skilled in the applicable technologies.

What is claimed is:

1. Apparatus for providing a magnetic field in molten steel passing from a submerged entry nozzle into and through a mold for casting molten steel, the mold having a pair of opposed wide faces, said apparatus comprising:

a set of pairs of magnetic field cores, each pair located adjacent a discrete selected portion of the mold, each core of any one pair of cores located adjacent a discrete opposed wide face of the mold, and all cores adjacent one opposed wide face of the mold connected to all cores adjacent the other opposed wide face of the mold by a yoke made of magnetic material, so that when the mold contains molten steel a set of magnetic circuits is formed, each one of which passes through one core of one discrete pair of cores, the yoke, the other core of that pair of cores, and the adjacent selected portion of the mold and the molten steel contained therein; and a set of pairs of energizing coils through each of which coils a discrete electrical current may be passed, each pair of coils associated with a discrete one of said pairs of cores and each coil of each discrete pair of coils associated with a discrete one of the pair of cores, so that when one pair of coils are energized magnetic field lines extend from one wide face of the mold to the other wide face of the mold between the associated cores, whereby the local magnetic field in any one of the selected portions of the mold may be varied by varying the electrical currents passing through the pairs of coils associated with the pairs of magnetic field cores near that selected portion of the mold so as to modify flow characteristics of molten steel exiting the submerged entry nozzle into the casting mold.

2. Apparatus as defined in claim 1, wherein the mold is generally vertically oriented so that the molten steel passes generally vertically therethrough, exiting the mold with a solid shell, and wherein at least one of the magnetic field cores is provided with removable laminar elements arrangeable in at least one vertically stacked array that extends into proximity with the wide mold face.

3. Apparatus as defined in claim 2, wherein the magnetic field cores, including at least some of the removable laminar elements, and the yoke are made of iron or an alloy chiefly composed of iron.

4. Apparatus as defined in claim 3, wherein the removable laminar elements are stackable rectangular parallelepiped plates.

5. Apparatus for providing a magnetic field in molten steel passing from a submerged entry nozzle into and through a mold for casting molten steel, the mold having a pair of opposed wide faces, said apparatus comprising:

a pair of magnetic field cores, each core located adjacent to a discrete opposed wide face of the mold and connected to the other core by a yoke so that a magnetic circuit is formed that passes through one of the cores, the yoke, the other one of the cores, and the mold containing molten steel, each magnetic field core having at least two arrays of vertically stacked removable laminar elements arranged in a horizontal series, each array extending into proximity with the adjacent wide mold face of the casting mold; and a pair of energizing coils through which electrical current may be passed to produce a magnetic field in molten steel in the casting mold, each coil associated with one discrete magnetic field core, whereby the magnetic field to be produced in molten steel in the casting mold when electrical current passes through the coils may be varied by the removal of laminar elements from at least one of the arrays so as to modify flow characteristics of molten steel exiting the submerged entry nozzle into the casting mold.

6. Apparatus as defined in claim 5, wherein the magnetic field cores, including at least some of the removable laminar elements, and the yoke are made of iron or an alloy chiefly composed of iron.

7. The apparatus as defined in claim 6, wherein the removable laminar elements are stackable rectangular parallelepiped plates together forming selectably at least a portion of the cores.

* * * * *